US007388458B2

(12) United States Patent
Svensson et al.

(10) Patent No.: US 7,388,458 B2
(45) Date of Patent: Jun. 17, 2008

(54) DC EXTRACTING ARRANGEMENT AND A FILTER

(75) Inventors: Anders Svensson, Djursholm (SE); Jarmo Makinen, Vallentuna (SE)

(73) Assignee: Powerwave Technologies Sweden AB, Taby (SE)

( * ) Notice: Subject to any disclaimer, the term of this patent is extended or adjusted under 35 U.S.C. 154(b) by 140 days.

(21) Appl. No.: 11/252,888

(22) Filed: Oct. 19, 2005

(65) Prior Publication Data

US 2006/0111070 A1 May 25, 2006

Related U.S. Application Data

(60) Provisional application No. 60/619,689, filed on Oct. 19, 2004.

(51) Int. Cl.
*H01P 1/20* (2006.01)

(52) U.S. Cl. ..... 333/202; 333/207; 333/235

(58) Field of Classification Search ..... 333/202, 333/206, 207, 203, 219, 235
See application file for complete search history.

(56) References Cited

U.S. PATENT DOCUMENTS 5,023,579 A 6/1991 Bentivenga et al. ..... 333/203

FOREIGN PATENT DOCUMENTS

| | | |
|---|---|---|
| EP | 0746051 A1 | 12/1996 |
| JP | 56-89455 | 7/1981 |
| WO | WO01/97324 | 12/2001 |

*Primary Examiner*—Stephen E Jones
(74) *Attorney, Agent, or Firm*—Jacobson Holman PLLC

(57) ABSTRACT

The present invention relates to a DC extracting arrangement in a RF filter used for extracting a DC voltage and/or a low frequency signal (DC/Com. signal) superimposed on a RF signal. The DC/Com. signal is extracted using a low pass filter which is arranged inside the first resonator inside the filter. Preferably, the low pass filter is a tubular filter. The invention also relates to a filter housing made from Zinc or Zinc alloy.

13 Claims, 6 Drawing Sheets

DC EXTRACTING ARRANGEMENT AND A FILTER

This application claims the benefit of U.S. Provisional Application Ser. No. 60/619,689 filed Oct. 19, 2004.

BACKGROUND OF THE INVENTION

1. Field of the Invention

The present invention relates to an arrangement for extracting a DC or low frequency signal superimposed on a RF signal fed into a filter. The invention further relates to the filter that comprises a filter housing and a filter lid.

2. Description of the Related Art

A DC voltage and a low frequency communication signal are often superimposed on a RF signal fed into a filter for mobile communication. The DC voltage may be used to drive a low noise amplifier (LNA) in the filter and the low frequency communication signal contains information that is used internally in the filter, sent from the filter or passed through the filter, together or not with the DC voltage, without being distorted by the transfer function of the filter.

To be able to realize this, the DC voltage, together with the low frequency communication signal, have to be removed from the input signal before the RF signal enters the filter structure, and, if desired, the DC voltage and/or the low frequency communication signal may be added to the output of the filter.

Several solutions have been proposed during the years and FIGS. 1 and 2 disclose solutions which are described in more detail below. The principal function of the arrangement for extracting the DC voltage and the low frequency communication signal comprises a low pass filter (LP filter) arranged in parallel with an input coupling rod or first resonator. Both solutions described in FIGS. 1 and 2 have similar drawbacks, since they are difficult to produce in a reliable and stable way. There are risks for passive inter modulation (PIM) and it is difficult to control the tolerances of the structure which limits performance and makes the solutions described in connection with FIGS. 1 and 2 expensive to manufacture. Furthermore, RF tends to leak into the DC voltage and the low frequency communication signal due to the structure of the LP filter.

A structure similar to the claimed invention is disclosed in U.S. Pat. No. 5,023,579 by Salvatore et al., that describes an integrated band pass/low filter where the first and last resonators are coupled to associating connectors. Low pass filters are positioned within the first and last resonators and the RF signal fed into the resonators are subject to low pass filtration thus forming a band pass filter for the RF signal. Thus, the RF signal is subject to low pass filtering which is not the object of the invention.

SUMMARY OF THE INVENTION

The purpose of the invention is to provide a DC extracting arrangement, when extracting a DC voltage or low frequency signal superimposed on a RF signal being fed into a filter, that suppresses RF in the extracted DC voltage or low frequency signal.

A solution to the purpose is achieved with an arrangement in which the RF signal is fed into a first resonator of a RF filter structure, wherein said extracting arrangement comprises a low pass filter (LP filter) that provides the DC voltage or the low frequency signal outside the RF filter structure, characterized in that the first resonator is provided with a cavity, said LP filter is arranged inside the cavity of the first resonator, and the RF signal is coupled to the outside of the first resonator.

An advantage with the present invention is that a simplified structure is achieved and thus the filter containing the DC extracting device may be assembled in a more simplified way compared to prior art arrangements.

Another advantage is that the present invention provides a possibility to manufacture a filter having a DC extraction arrangement without soldering.

A further purpose of the invention is to provide a new way to produce a filter housing resulting in a more compact filter compared to prior art solutions.

This purpose is achieved by a filter comprising a filter housing and a filter lid, said filter having a threaded input connector, a threaded output connector, and at least one filter structure including cavities and resonators, characterized in that the filter housing is integrated with the threaded input/output connectors and the walls defining the cavities, and said filter housing is made from Zinc or Zinc alloy.

An advantage with the inventive filter is that it is possible to reduce the required tolerances in the manufacturing process which in turn will minimize the size of the internal structure of the filter and, furthermore, the inventive filter makes it possible to integrate, e.g., threaded connectors in the filter housing during casting.

Another advantage is that it is cheaper to manufacture a complex structure using Zinc.

An advantage with a preferred embodiment of the filter is that it is easier to cast the housing in Zinc compared to casting in aluminum, which will increase the lifetime of the tools needed when casting the housing.

The invention will now be described in connection with the attached drawings, which are provided in a non-limited way, to enhance the understanding of the invention.

DESCRIPTION OF THE PREFERRED EMBODIMENTS

Figure 1:
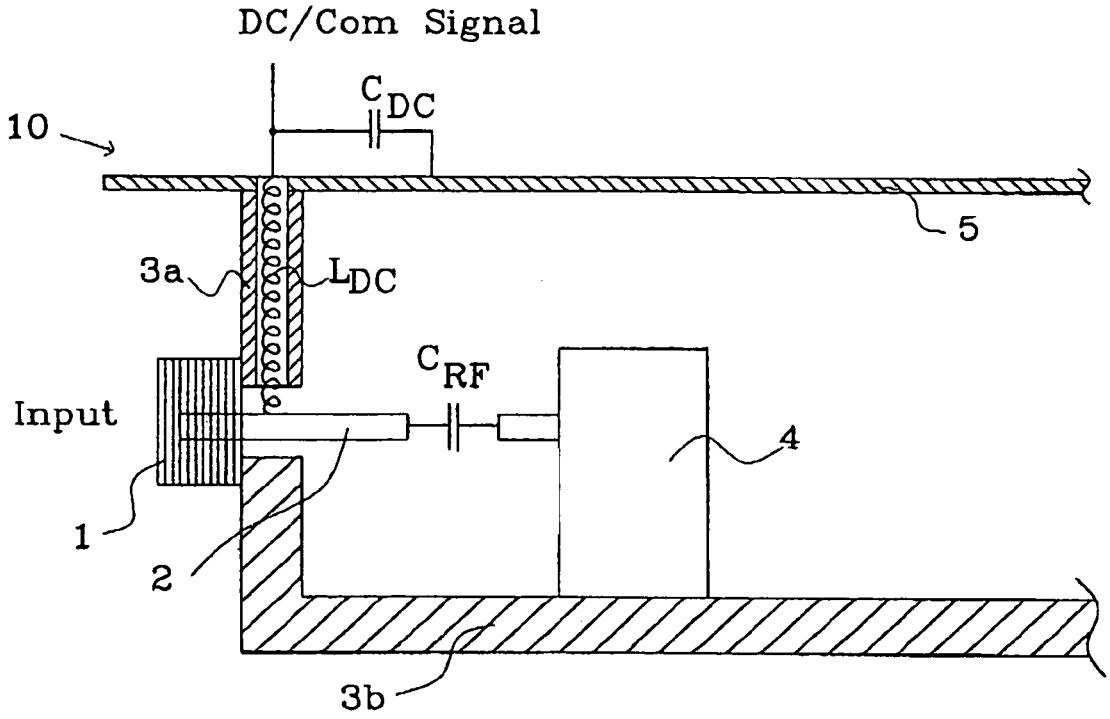
Fig. 1 (Prior Art)
FIG. 1 shows a first prior art arrangement for extracting DC voltage or low frequency signals superimposed on a RF signal.
Figure 2:
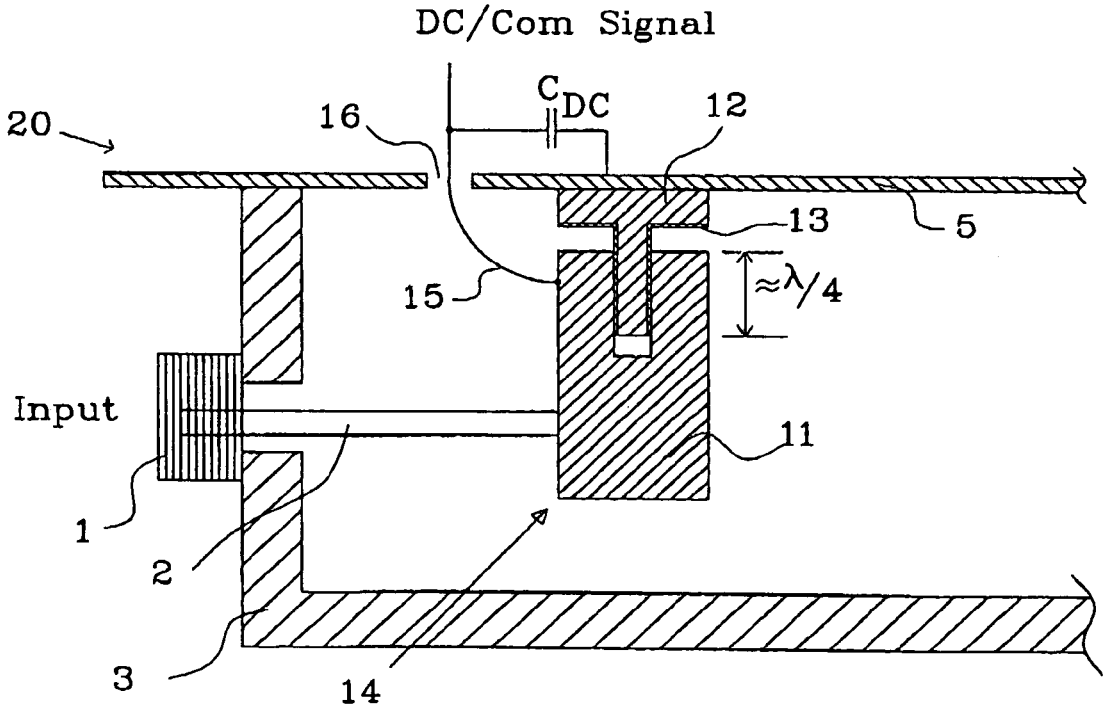
Fig. 2 (Prior Art)
FIG. 2 shows a second prior art arrangement for extracting DC voltage or low frequency signals superimposed on a RF signal.

FIGS. 1 and 2 describe the prior art solutions for a DC extracting arrangement in a RF filter, where the signal to be extracted (DC voltage or a low frequency signal usually used for communication purposes) is superimposed on a RF signal.

FIG. 1 shows a first type of prior art arrangement for extracting a DC voltage or low frequency in a RF filter 10 having a housing 3*a*, 3*b* and a lid 5. A common signal, comprising a RF signal with a superimposed DC voltage and/or low frequency signal, is fed into an input connector 1. A connector rod 2 is connected to the input connector 1 and the connector rod 2 is isolated from the filter housing 3*a*, 3*b*. A first resonator 4 is capacitively coupled to the input connector 1 via said connector rod 2 and a first capacitor $C_{RF}$. A first end of an inductor $L_{DC}$ is directly connected to the connector rod 2, usually by soldering, and a second end of the inductor $L_{DC}$ is connected to a second capacitor $C_{DC}$, which is located outside of the RF filter 10. The inductor $L_{DC}$ is located inside a part of the filter housing 3*a* and extends through the filter lid 5, which is secured to the housing by screws or similar fastening means. The inductor $L_{DC}$ and the second capacitor $C_{DC}$ together forms a low pass filter (LP filter), and the DC voltage and/or the low frequency communication signal (DC/Com. Signal) is available on the outside of the filter. The second capacitor $C_{DC}$ may be implemented on a PCB (not shown) attached to the filter lid 5.

There are drawbacks with the described DC extracting arrangement, especially concerning leakage of the RF signal into the DC/Com signal. Furthermore, the connection of the first end of the inductor $L_{DC}$ is difficult to achieve due to the small space available for soldering it to the connector rod 2.

The second type of DC arrangement shown in FIG. 2 also comprises a filter 20, having a housing 3 and a lid 5, an input connector 1 connected to a connector rod 2. The lid 5 is secured to the housing 3 in a similar manner as described in connection with FIG. 1, and a first resonator 14 is located inside the filter 20.

The connector rod 2, which is isolated from the housing 3, is directly connected to an isolated part 11 of the first resonator 14, which means that the common signal, comprising the RF signal with the superimposed DC voltage and/or low frequency signal, is fed into the input connector 1 via the connector rod 2 to the isolated part 11 of the first resonator 14. The first resonator further comprises a base part 12, which is electrically grounded to the lid 5 and isolated from the isolated part 11 by an isolating layer 13. A capacitor $C_{RF}$ is thus created.

An end of a wire 15, acting as an inductor $L_{DC}$, is connected to the isolated part 11 of the first resonator 14, and the wire 15 is arranged through a hole 16 in the lid 5. The second end of the wire is connected to a second capacitor $C_{DC}$, which is located outside of the RF filter 20. The second capacitor $C_{DC}$ may naturally be implemented on a PCB (not shown) if desired. The inductor $L_{DC}$ and the second capacitor $C_{DC}$ forms, as described in connection with FIG. 1, a low pass filter.

The second type of prior art DC extracting arrangement also has drawbacks, especially regarding RF leakage in the DC/Co. signal, but also in the complex structure of the DC extracting arrangement where soldering of the wire to the first resonator 14 is necessary to obtain a good contact.

The basic idea of the invention, as described below, is to arrange the LP filter inside the first resonator and couple the RF signal to the outside of the first resonator. This will in turn suppress the RF signal in the DC/Com. signal, but also provide a simplified manufacturing process of the filter.

Figure 3:
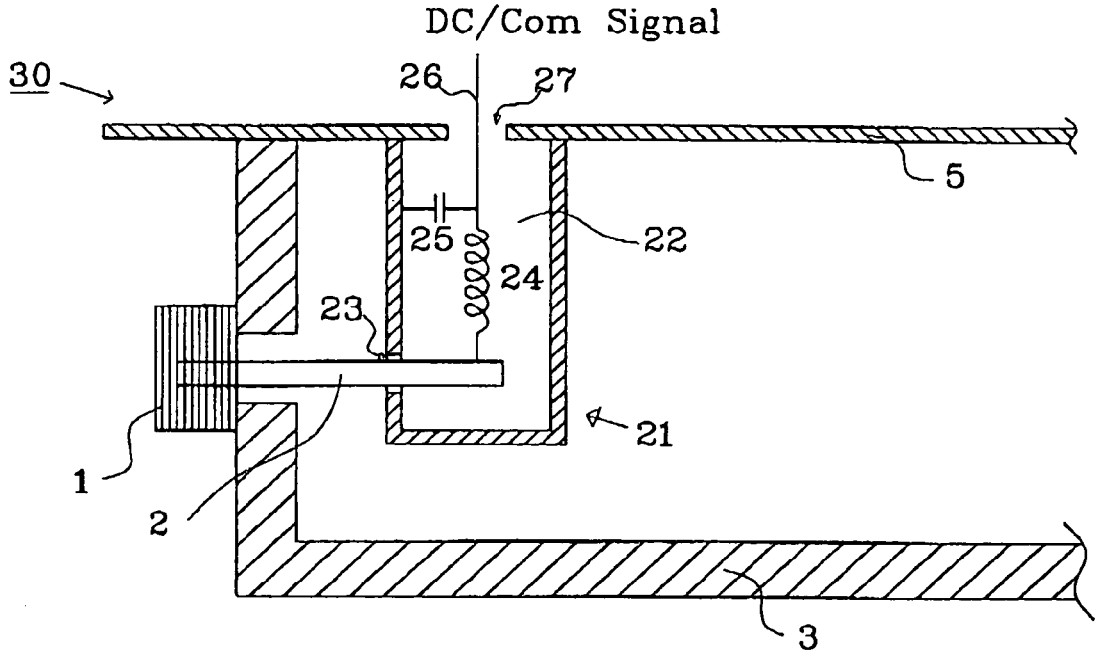
FIG. 3 shows a first embodiment of a DC extracting arrangement according to the present invention.

FIG. 3 shows a first embodiment of a DC extracting arrangement according to the present invention arranged in a filter 30, having a housing 3 and a lid 5. An input connector 1 and a connector rod 2, isolated from the housing 3, are provided to feed the common signal, comprising the RF signal with the superimposed DC/Com. signal, into the filter 30.

A resonator 21, which could be the first resonator in a filter structure or a coupling rod for several filter structures, is provided with a cavity 22. The resonator 21 is electrically grounded to the filter lid 5 and the coupling rod 2 extends through an opening 23 in the resonator 21 into the cavity 22. A low pass filter (LP filter) comprising an inductor 24 and a capacitor 25 are provided inside the cavity 22 and the DC/Com. signal is fed out from the cavity 22, through an opening 27 in the filter lid 5.

The LP filter is realized by connecting a first end of the inductor 24 with the end of the connector rod 2 extending into the cavity 22. The second end of the inductor 24 is connected in series with the capacitor 25, which is grounded to the cavity wall, and the DC/Com. signal is extracted by connecting a wire 26 to the second end of the inductor 24 and leading it through the opening 27 in the filter lid 5.

Figure 4A:
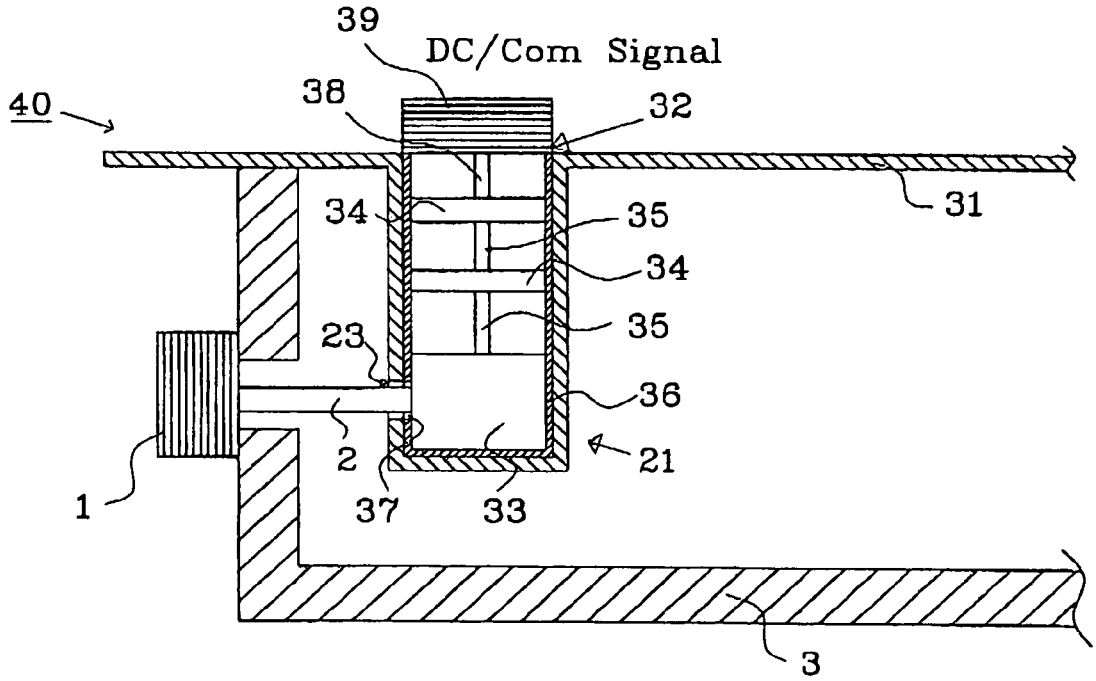
FIGS. 4*a* and 4*b* show a second and a third embodiment of a DC extracting arrangement according to the present invention.

The described embodiment illustrates the basic idea of the invention and FIG. 4*a* describes a preferred embodiment of the present invention.

In FIG. 4*a*, similar features have the same reference numerals as previously used. The major difference between the previously described embodiment in FIG. 3 is that the LP filter is realized as a tubular LP filter 32. The connector rod 2 is conductively attached to the lower part 33 of the tubular LP filter 32 and an isolating layer 36, e.g., PTFE or Teflon, is provided between the tubular LP filter 32 and the cavity wall. An opening 37 in the isolating layer 36 is provided to facilitate the attachment of the conductor rod 2 to the lower part 33 of the tubular LP filter 32.

The tubular LP filter 32 further comprises, in this embodiment, two discs 34, where the discs and the lower part 33 are interconnected with thin rods 35. Each disc will create a capacitance to the cavity wall and each thin rod will create an inductance, thus crating a LP filter. The DC/Co. signal is retrieved at the centre 38 of the upper end of the tubular LP filter.

In this embodiment, the filter is provided with a modified lid 31 which has the resonator 21 integrated with the lid 31 and, furthermore, a DC connector 39 is provided on the outside of the lid 31 to which the LP filter output 38 is connected.

Figure 4B:
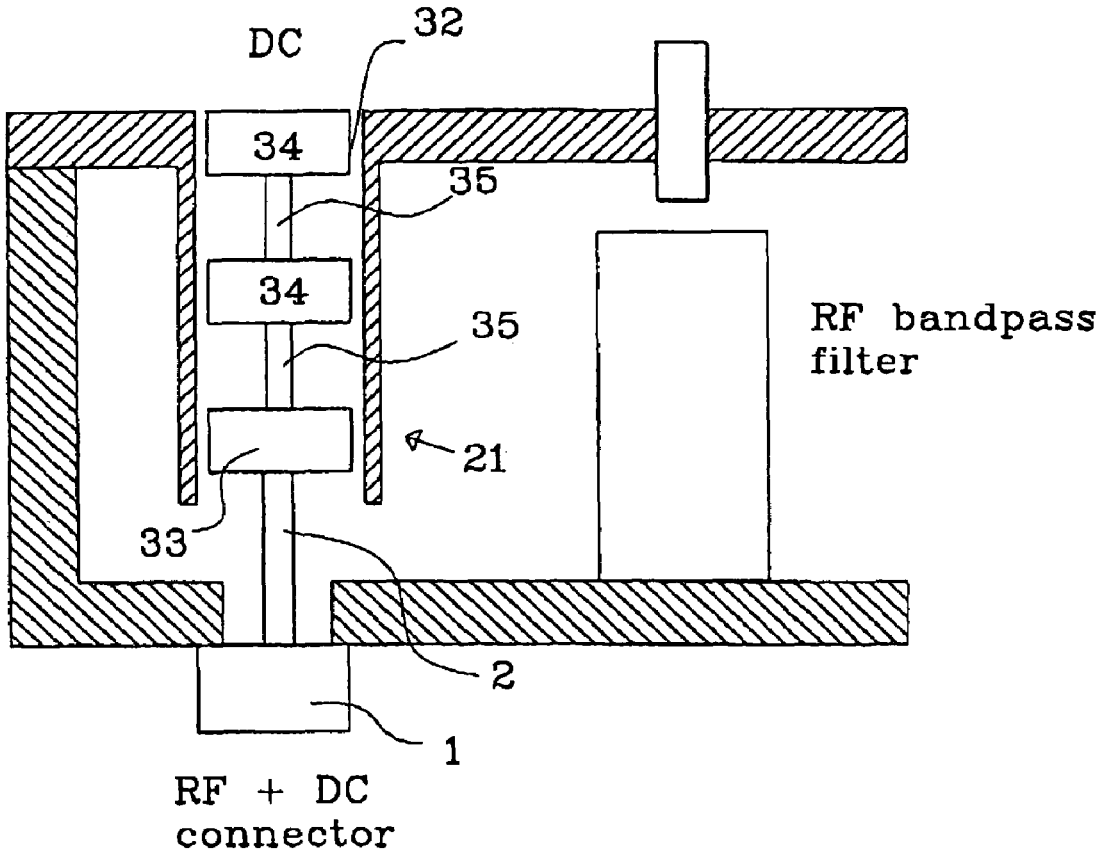

FIG. 4*b* shows a third embodiment of the present invention. The embodiment in FIG. 4*b* essentially works similar to the embodiment shown in FIG. 4*a*, and as in FIG. 4*a*, similar features have the same reference numerals as previously used. As in FIG. 4*a*, the LP filter is realized as a tubular LP filter 32. In this embodiment, however, the connector rod 2 is conductively attached to the lower part 33 of the tubular LP filter 32 of the resonator 21 from underneath in the figure, instead of from the left side as in FIG. 4*a*. Further, the isolating layer 36 has been omitted and isolation is instead provided by an air gap between the cavity wall and the discs 34 and the lower part 33. Also, the bottom portion of the cavity wall has been omitted. As in FIG. 4*b*, the DC/Co. signal is retrieved at the upper end of the tubular LP filter, preferably from the centre of the uppermost disc 34. As in the previous embodiments, the RF signal is coupled to the outside of the resonator 21 and can be forwarded to a bandpass filter 41.

Figure 5:
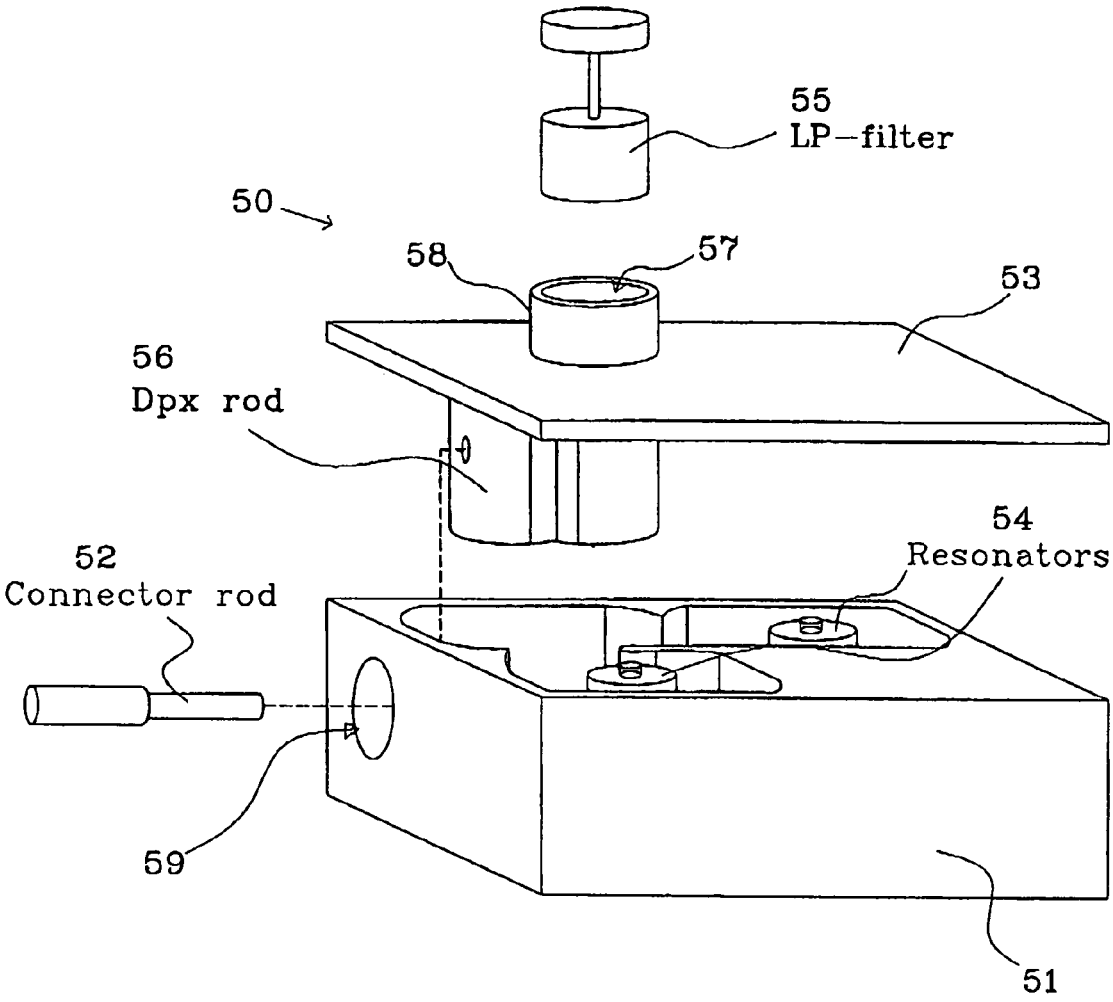
FIG. 5 shows a fourth embodiment of a DC extracting arrangement implemented in a filter.

FIG. 5 shows an exploded perspective view of a fourth embodiment 50 of a filter having a DC extracting arrangement according to the present invention. The filter comprises five different parts: filter housing 51, a connector rod 52, a filter lid 53, resonators 54, and LP filter 55.

A coupling rod 56, having a cavity 57, is integrated with the filter lid 53, as described in connection with FIG. 4*a*, but in this embodiment, the edge of the coupling rod stretches through the lid 53 to form a rim 58 on the outside of the filter. An isolating layer (not shown) is mounted inside the cavity 57 to prevent short-circuiting of the LP filter 55 when it is mounted inside the cavity. The filter housing 51 is provided with an opening 59 for inserting the conductor rod 52 when attaching it to the LP filter 57 after the resonators 54 and the lid 53 have been mounted to the housing 51.

The filter lid may also be provided with a tuning means, such as a tuning screw, for tuning the frequency of the coupling rod. The tuning means is accessible from the outside of the filter when mounted.

Figure 6A:
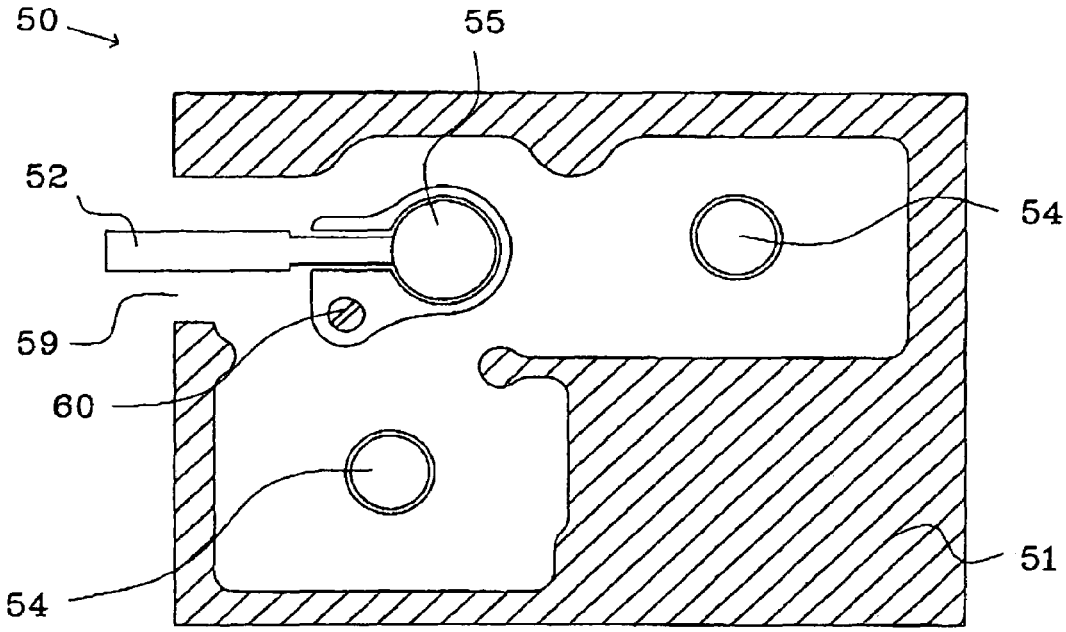
FIGS. 6*a* and 6*b* show cross-sectional views of the filter in FIG. 5.
Figure 6B:
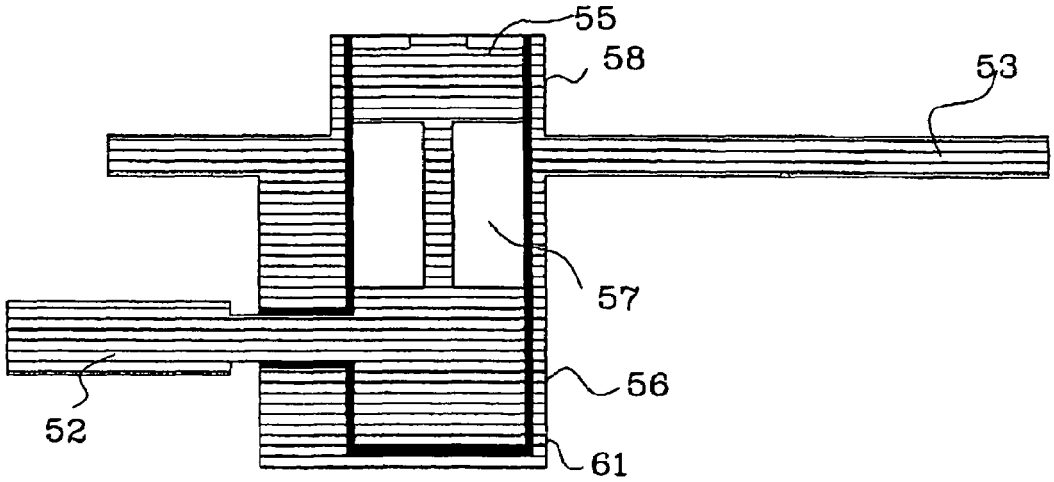

FIGS. 6*a* and 6*b* show cross-sectional views of the filter in FIG. 5. FIG. 6*a* is a cross-sectional top view of the filter where the tuning means 60 is clearly shown. The connector rod 52 is attached to the LP filter in such a way to ensure a good electrical contact, e.g., threads. FIG. 6*b* shows a partial cross-sectional view of the lid 53, including the mounted LP filter 55 and the connector rod 52. The isolating layer 61 may be seen in the cavity 57 between the LP filter 55 and the integrated coupling rod 56. The isolating layer could be any material that has a dielectric property.

The DC extracting arrangement has only been described as a way to extract low frequency signals, e.g., DC signals or signals having a frequency up to a few MHz (2-4 MHz), but the same arrangement may naturally be used when adding DC and/or low frequency communication signals to a RF signal.

Figure 7:
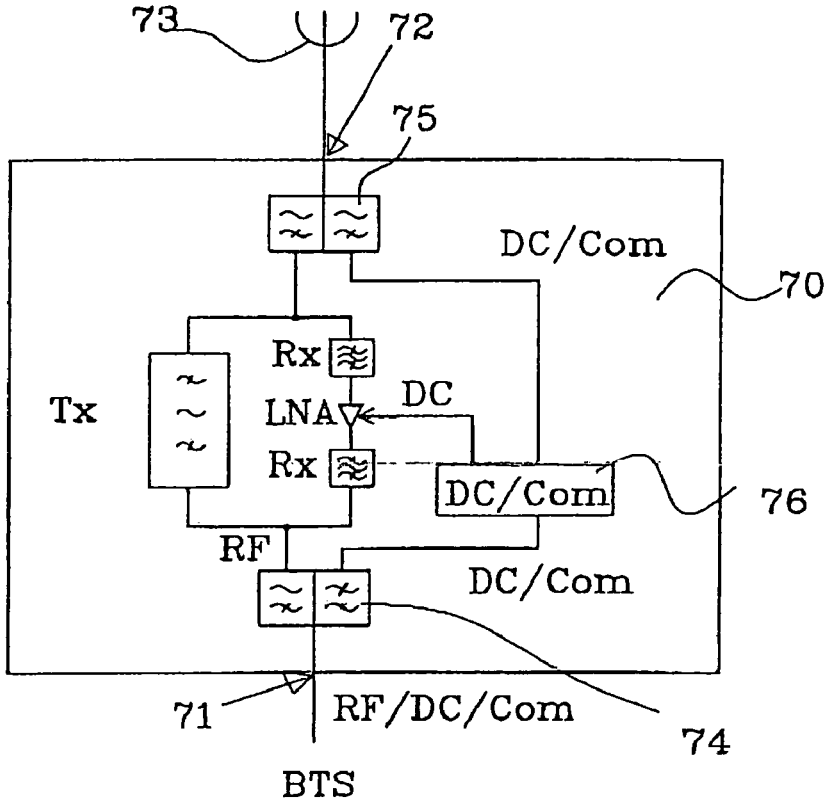
FIG. 7 shows a block diagram of a first embodiment of a filter including a DC extracting arrangement.

FIG. 7 shows a block diagram illustrating a duplex filter 70 for a mobile telecommunication system. The input 71 of the duplex filter 70 could be connected to a base station (BTS) and the output 72 could be connected to an antenna 73.

The duplex filter 70 comprises: a transmitting filter structure $T_x$; two receiving filter structures $R_x$ with a low noise amplifier LNA in between; a DC/Com. signal extracting arrangement 74; and a DC/Com. signal adding arrangement 75.

The LNA requires a DC voltage to operate and that is provided by circuits 76. The low frequency communication signal is normally not used within the duplex filter 70, but is forwarded from the input 71 to the output 72 using the DC extracting and adding arrangements.

Figure 8:
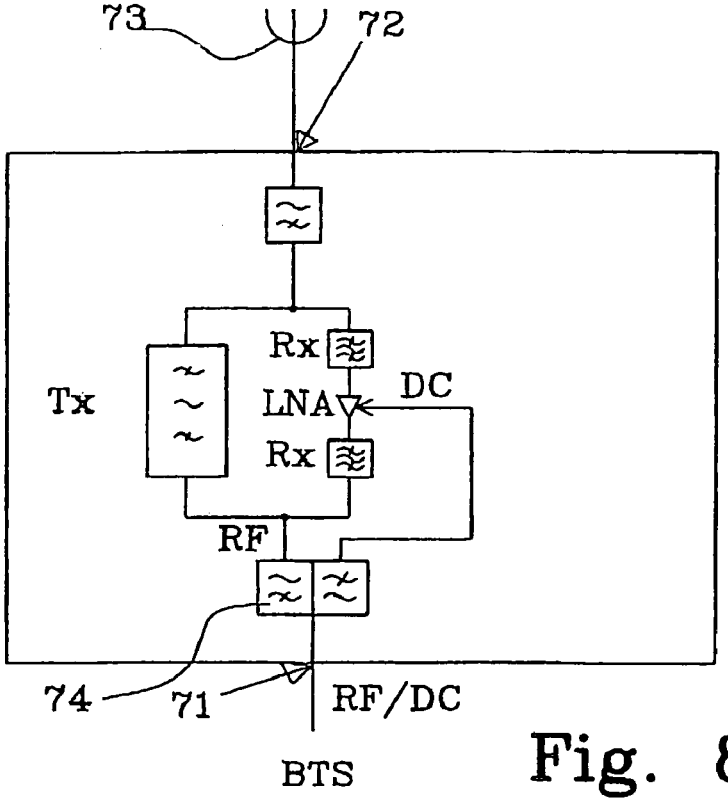
FIG. 8 shows a block diagram of a second embodiment of a filter including a DC extracting arrangement.

FIG. 8 illustrates a block diagram when no low frequency communication signal is present and the DC voltage only is used to drive the LNA.

The filter shown in FIG. 5 is preferably made from molded Zinc which makes it possible to reduce the size of the filter housing since thinner walls may be manufactured using Zinc, instead of using traditional material, such as aluminum. Furthermore, the use of Zinc makes it possible to integrate threaded input and output connectors to the housing. The use of molded Zinc has the distinct advantage that the molding takes place at a lower pressure and temperature compared to aluminum, which in turn will increase the lifetime of the molding tools used during the manufacturing process.

Since it is possible to include complex structures in the molded filtering housing, the result is a much cheaper product compared to traditional filters made from aluminum.

Furthermore, it is also advantageous to mold the filter lid, including the DC extracting arrangement as described in connection with FIGS. 5, 6*a* and 6*b*, in Zinc. The temperature coefficient of both the housing and the lid will then be approximately equal which will increase the performance of the filter during operation. However, the lid is preferably coated with a highly conductive material, such as silver, to increase the performance of the filter. Moreover, the material used for the filter housing and lid may also be a Zinc alloy. Zinc alloys that could be used are ZP0410 or ZP0810. ZP0410 is made according to standard EN-1774. This alloy is a good "standard alloy". ZP0810 is made according to standard EN-1774, which is also called ZAMAK 8 (ZnA18Cu1). It is stronger than ZP0410, but more fragile and has a less expansion coefficient. Other possible Zinc alloys are AP0400 according to standard EN-1774 or ZP0610 according to standard EN-1774.

What is claimed is:

1. An extracting arrangement for extracting a DC voltage or low frequency signal superimposed on a radio frequency signal (RF signal), said RF signal is fed into a first resonator of a RF filter structure, said extracting arrangement comprising a low pass filter (LP filter) providing the DC voltage or the low frequency signal outside the RF filter structure, the first resonator being provided with a cavity, said LP filter being arranged inside the cavity of the first resonator, and the RF signal being coupled to the outside of the first resonator. filter housing is made of Zinc or Zinc alloy.

2. The extracting arrangement according to claim 1, wherein the first resonator is a coupling rod providing RF signals to a first filter structure (Rx), and receiving RF signals from a second filter structure (Tx).

3. The extracting arrangement according to claim 1, wherein a tuning means for tuning the frequency of the first resonator is integrated in the first resonator.

4. The extracting arrangement according to claim 3, wherein the tuning means is a tuning screw.

5. The extracting arrangement according to claim 1, wherein the LP filter is a tubular LP filter.

6. The extracting arrangement according to claim 5, wherein the tubular LP filter is made from a single piece of material.

7. The extracting arrangement according to claim 1, wherein said first resonator is integrated with the filter lid or the filter housing.

8. The extracting arrangement according to claim 7, wherein the first resonator is integrated with the lid and made of Zinc (Zn) or Zinc alloy.

9. The extracting arrangement according to claim 8, wherein the filter housing is made of Zinc or Zinc alloy.

10. An extracting arrangement for extracting a DC voltage or low frequency signal superimposed on a radio frequency signal (RF signal), said RF signal is fed into a first resonator of a RF filter structure, said extracting arrangement comprising a low pass filter (LP filter) providing the DC voltage or the low frequency signal outside the RF filter structure, the first resonator being provided with a cavity, said LP filter being arranged inside the cavity of the first resonator, and the RF signal being coupled to the outside of the first resonator, the LP filter being a tubular LP filter and the first resonator being a coupling rod providing RF signals to a first filter structure (Rx), and receiving RF signals from a second filter structure (Tx).

11. A filter comprising a filter housing and a filter lid, and at least one filter structure including cavities and resonators, said filter housing being made from Zinc or Zinc alloy, and the filter housing being integrated with threaded input/output connectors and walls defining the cavities, a DC extracting arrangement connected to the input of the filter, including a tubular low pass filter (LP filter) for extracting a DC voltage or low frequency signal superimposed on a radio frequency signal (RF signal), said RF signal being fed into a first resonator of the RF filter structure, and said DC voltage or low frequency signal being fed from said input via said tubular LP filter to outside of said filter housing.

12. The filter according to claim 11, wherein a DC adding arrangement, is mounted at the output of the filter.

13. The filter according to claim 11, wherein the first resonator is a coupling rod providing RF signals to a first filter structure (Rx), and receiving RF signals from a second filter structure (Tx).

* * * * *